US006325690B1

(12) United States Patent
Nelson

(10) Patent No.: US 6,325,690 B1
(45) Date of Patent: Dec. 4, 2001

(54) TOY TOP WITH MESSAGE DISPLAY AND ASSOCIATED METHOD OF INITIATING AND SYNCHRONIZING THE DISPLAY

(76) Inventor: Webb Nelson, 19180 144th Ave. NE., Woodinville, WA (US) 98072

( * ) Notice: Subject to any disclaimer, the term of this patent is extended or adjusted under 35 U.S.C. 154(b) by 0 days.

(21) Appl. No.: 09/609,865

(22) Filed: Jul. 6, 2000

(51) Int. Cl.[7] ..... A63H 1/24
(52) U.S. Cl. ..... 446/25; 446/129; 446/242
(58) Field of Search ..... 446/242, 247, 446/256, 260, 259, 485, 129, 130; 362/234; 318/128, 130

(56) References Cited

U.S. PATENT DOCUMENTS

| | | | | |
|---|---|---|---|---|
| 3,266,187 | * | 8/1966 | Felsher | 446/130 |
| 3,783,550 | * | 1/1974 | Andrews | 446/484 |
| 3,798,833 | * | 3/1974 | Campbell | 446/130 |
| 3,867,786 | * | 2/1975 | Greenblatt | 446/130 |
| 4,114,305 | * | 9/1978 | Wohlert et al. | 43/17.6 |
| 4,562,516 | | 12/1985 | Chastain . | |
| 4,728,871 | * | 3/1988 | Andrews | 318/130 |
| 5,007,877 | * | 4/1991 | Watson | 446/242 |
| 5,026,057 | * | 6/1991 | Watford | 273/108.1 |
| 5,041,947 | | 8/1991 | Yuen et al. . | |
| 5,057,827 | * | 10/1991 | Nobile et al. | 345/31 |
| 5,406,300 | | 4/1995 | Tokimoto . | |
| 5,791,966 | * | 8/1998 | Capps et al. | 446/242 |
| 5,810,640 | * | 9/1998 | Clarke et al. | 446/132 |

* cited by examiner

*Primary Examiner*—Jacob K. Ackun, Jr.
*Assistant Examiner*—F. Francis
(74) *Attorney, Agent, or Firm*—LaMorte & Associates

(57) ABSTRACT

A system and method for initiating, orienting and synchronizing the electronic display on a top or a similar spinning object. The system includes a top on which is disposed an array of lights which forms the electronic display. The electronic display lights when an external activation device is brought into close proximity to the spinning top. Within the top is a detector that detects when the external activation device is brought within a predetermined distance of said top. The detector is connected to circuitry that starts the electronic display when the external activation device is detected. The circuitry also orients the electronic display depending upon the location of the external activation device relative the top. Lastly, the circuitry synchronizes the electronic display as a function of the rate of spin of the detector past the external activation device.

7 Claims, 4 Drawing Sheets

TOY TOP WITH MESSAGE DISPLAY AND ASSOCIATED METHOD OF INITIATING AND SYNCHRONIZING THE DISPLAY

BACKGROUND OF THE INVENTION

1. Field of the Invention

The present invention relates to toy tops. More particularly, the present invention is related to toy tops that contain a message display that displays a readable message as the toy top is spinning.

2. Description of the Prior Art

Spinning tops have been a popular children's toy for hundreds of years. As such, the prior art record is replete with different types of toy tops. Tops have been created in most every conceivable shape, size and style.

In the many years that tops have been in existence, many tops have been designed with various secondary features that make the top more interesting to watch as the top spins. One such secondary feature is an electronic message display. Electronic message displays utilize a line of LEDs. The LEDs are placed on the moving surface of the top. As the top spins, the LEDs are sequentially lit. The result is that the LEDs are capable of displaying alpha-numeric characters that are readable to a person watching the spinning surface of the top. The technology of lighting a row of LEDs on a moving surface to produce alpha-numeric characters is described in U.S. Pat. No. 5,406,300 to Tokimoto. The application of that technology to a spinning toy top is disclosed in U.S. Pat. No. 5,791,960 to Capps.

In order for an electronic display on a moving object to be readable, the lighting of the various LEDs within the display must be synchronized to the rate of movement of the surface on which the LEDs are located. If the lighting of the LEDs is not synchronized to the movement of the LEDs, the message set forth by the LEDs will appear as a blur and will not be readable.

In prior art systems, the methods used to synchronize the lighting of the LEDs are commonly done in one of two ways. In the first application, the moving surface contains some sort of internal sensor that can sense the rate of speed of the moving object containing the display. This technique is used in the cited Tokimoto patent. The second type of technique is to preprogram the lighting of the LEDs to certain speeds. As such, any message set forth by the LEDs is not readable until the speed of movement of the LEDs matches the preprogrammed speed. This second technique is disclosed in the cited Capps patent.

The present invention is an improvement over the prior art toy tops that have electronic displays. The present invention toy top contains a unique system and method of synchronizing a display on a top to its speed of rotation.

SUMMARY OF THE INVENTION

The present invention is a system and method for initiating, orienting and synchronizing the electronic display on a top or a similar spinning object. The system includes a top on which is disposed an array of lights which forms the electronic display. The electronic display lights when an external activation device is brought into close proximity to the spinning top. Within the top is a detector that detects when the external activation device is brought within a predetermined distance of said top. The detector is connected to circuitry that starts the electronic display when the external activation device is detected. The circuitry also orients the electronic display depending upon the location of the external activation device relative the top. Lastly, the circuitry synchronizes the electronic display as a function of the detector's rate of spin past the external activation device.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

Although the present invention system and method can be applied to most any moving object with an LED display, such as a yo-yo, gyroscope, spinning disk or the like, the present invention system and method are particularly well suited for use with a toy top. Accordingly, by way of example, the present invention system and method will be described embodied within a toy top in order to set forth the best mode contemplated for the invention.

Figure 1:
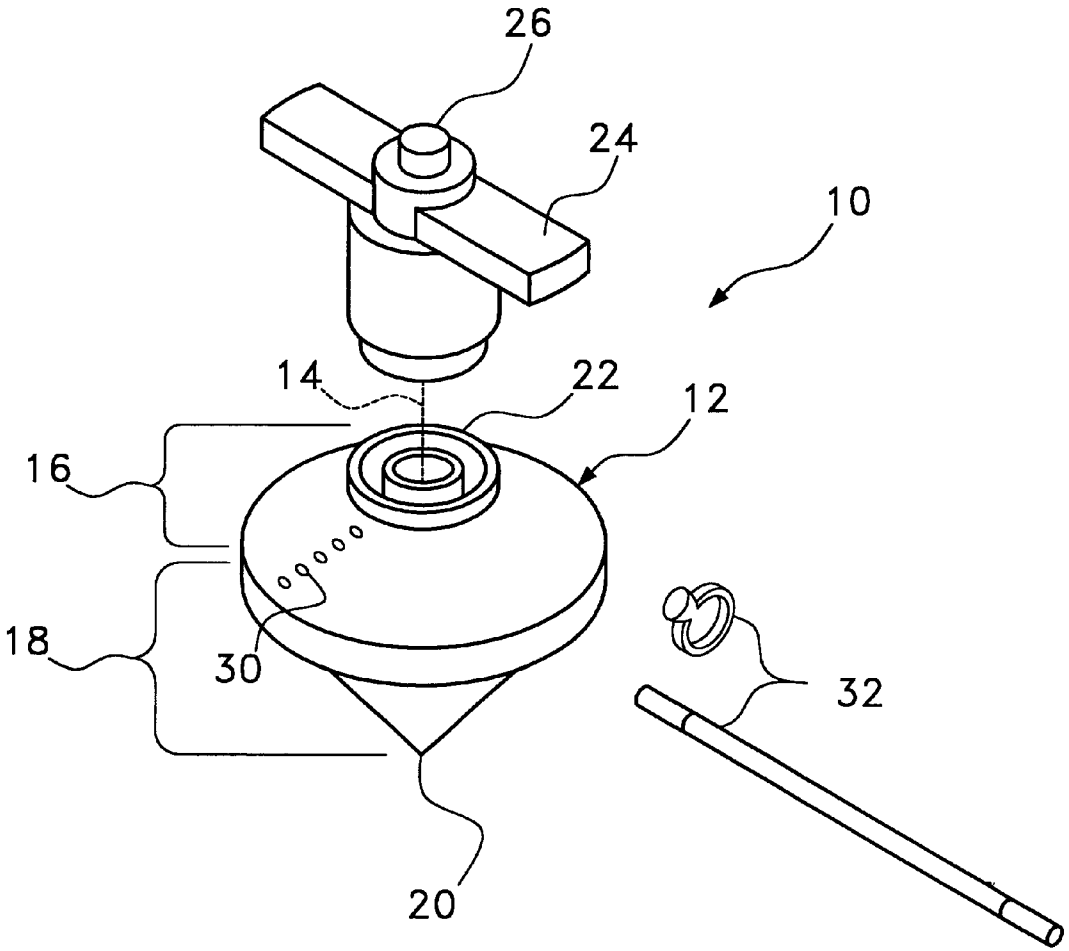
FIG. 1 is perspective view of a toy top system in accordance with the present invention.

Referring to FIG. 1, a toy top system 10 is shown in accordance with the present invention. The system 10 includes a toy top 12. The toy top 12 has a central axis 14 around which the toy top spins. The weight of the toy top 12 is symmetrically disposed around the central axis 14 of the toy top 12 so that the toy top 12 is stable when it spins.

The toy top 12 has a top section 16 and a bottom section 18 that join together at a common line. The line at which the top section 16 and the bottom section 18 of the toy top 12 join is the widest point of the toy top 12. The bottom surface 18 of the toy top 12 terminates at a base point 20. The base point 20 extends through the central axis 14 of the toy top 12. The toy top 12 balances on the base point 20 as the toy top 12 rotates about the central axis 14. Like most toy tops 12, the toy top 12 must be rotating above a predetermined minimum rotational speed in order to remain balanced on the base point 20. Once the rotational speed of the toy top 12 falls below the threshold speed, the toy top falls to the side.

On the top section 16 of the toy top 12 is a central hub 22. The central axis 14 of the toy top 12 passes through the central hub 22. The central hub 22 is configured to engage a spring loaded launcher mechanism 24. The launcher mechanism 24 is used to spin the toy top 12. The launcher mechanism 24 selectively attaches to the central hub 22 of the toy top 12. Once attached, the toy top 12 is rotated relative to the launcher mechanism 24. The rotation of the toy top 12 winds a spring within the launcher mechanism 24. When the release button 26 at the top of the launcher mechanism 24 is pressed, the launcher mechanism 24 and the toy top 12 separate and the potential energy stored in the wound spring of the launcher mechanism 24 is transferred to the toy top 12 as rotational energy. The toy top 12 is thus spun at a predetermined initial rate of rotation.

Launchers for toy tops are well known. Thus the internal structure of the launcher need not be specifically described.

Rather, any prior art toy top launching mechanism can be adapted for use by the present invention.

On the top section 16 of the toy top 12 are also positioned an array of light emitting diodes (LEDs) 30. The LEDs 30 extend from the central hub 22 of the toy top 12 toward the periphery of the toy top 12. In the shown embodiment, the array of LEDs 30 is a single straight line of LEDs. It will be understood that the array of LEDs 30 can be a matrix of LEDs where multiple LEDs are arranged in rows and columns. The use of a single row of LEDs is merely exemplary.

The array of LEDs 30 can either be located on the top surface of the toy top 12 or under the top surface of the toy top 12. If the array of LEDs 30 is located under the top surface of the toy top 12, then the top surface of the toy top 12 above the array of LEDs must be transparent so that the array of LEDs 30 can be observed from a point above the toy top 12.

In FIG. 1, two external activation devices 32 are shown. An external activation device can be a magnet, a light source, a radio signal source or any other device capable of sending a signal or triggering a signal in the toy top 12 without physically contacting the toy top 12. The external activation device can be embodied in an external object, such as a ring, a wand or any other object.

Figure 2:
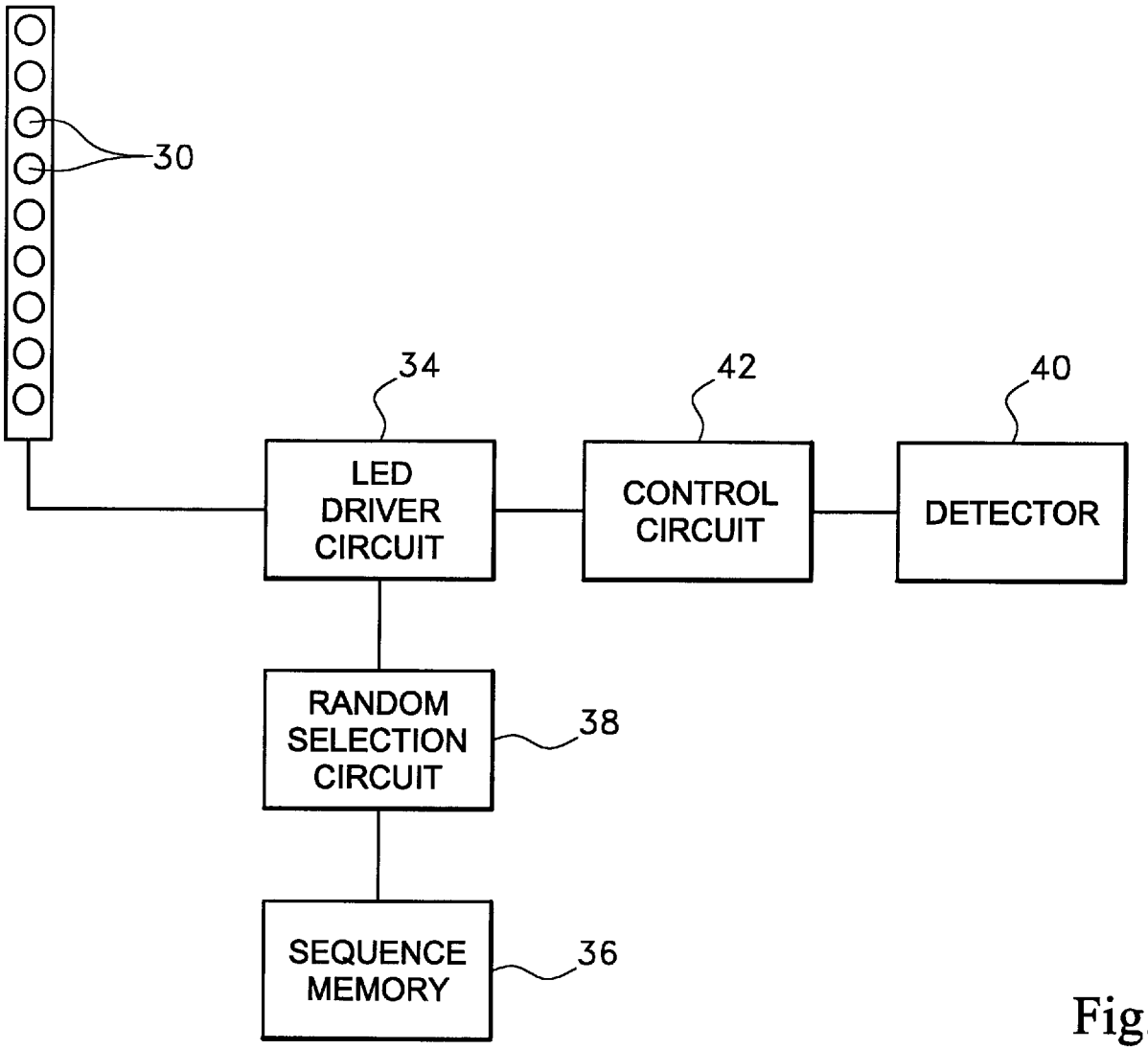
FIG. 2 is a schematic of a toy top in accordance with the present invention.

Referring to FIG. 2, there is a circuit schematic for the embodiment of the present invention toy top 12 shown in FIG. 1. As can be seen from FIG. 2, the toy top 12 has an array of LEDs 30. The LEDs in the array are lit in various sequences depending upon what message the array of LEDs 30 is to display as it spins with the toy top 12. The actual lighting of the LEDs in the array is controlled by an LED driver circuit 34. The LED driver circuit 34 is coupled to a sequence memory 36. The sequence memory 36 stores one or multiple lighting sequences in which the LEDs in the array can be lit. The light sequences stored in the sequence memory 36 can correspond to various words, phrases, numbers and/or images.

The LED driver circuit 34 can read lighting sequences from the sequence memory 36 in some predetermined order of priority. However, in the shown embodiment, the circuitry of the toy top 12 also includes a random selection circuit 38. The random selection circuit 38 causes the LED driver circuit 34 to randomly select various lighting sequences from the options contained within the sequence memory 36.

Also contained within the circuitry of the toy top is a detector 40. The detector 40 can be a magnetic field detector, a photodetector or a radio signal detector. As such, the detector 40 is capable of detecting a magnetic field, a light signal or a radio signal. The detector 40 is coupled to a control circuit 42. The control circuit 42 monitors the detector 40. If the control circuit 42 reads data from the detector 40 that matches some predetermined criteria, then the control circuit 42 triggers the operation of the LED driver circuit 34 and thus the lighting o f the array of LEDs 30. If a preprogrammed criteria is never detected, the LED driver circuit 34 is not activated and the array of LEDs 30 never lights.

Figure 3:
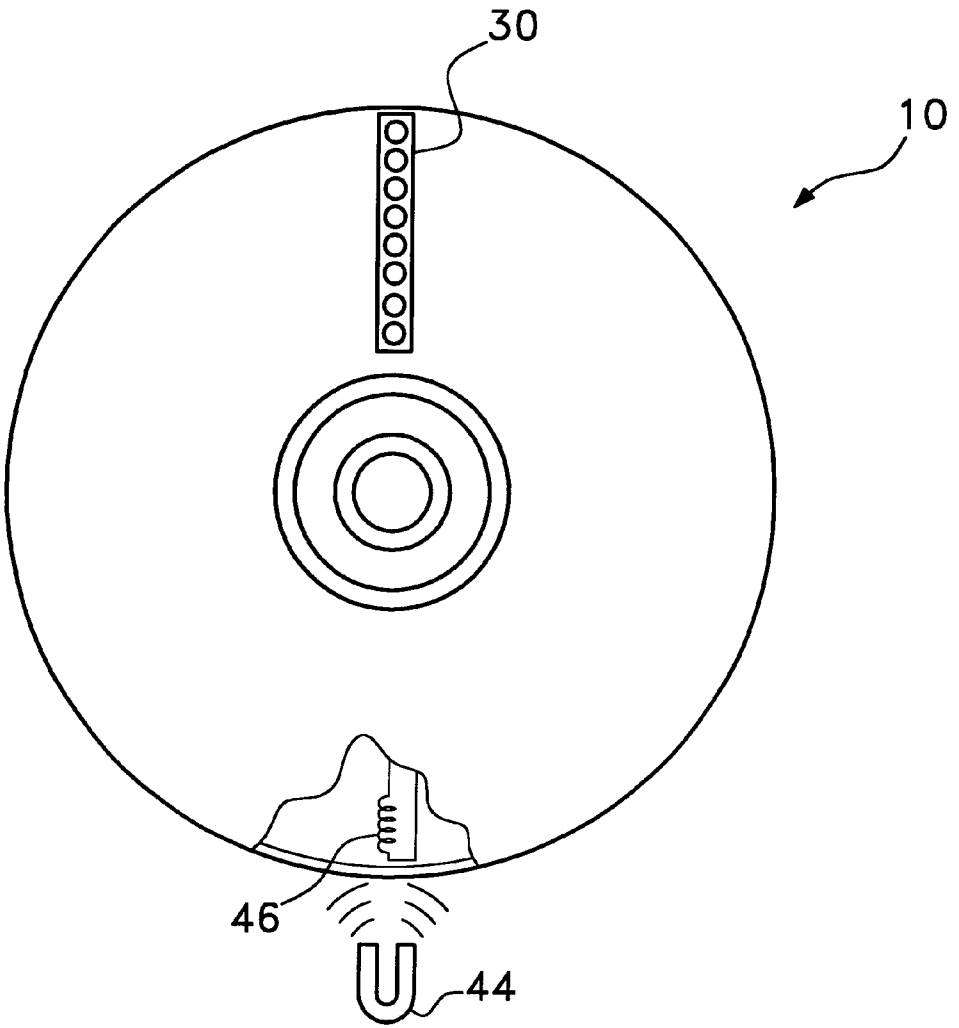
FIG. 3 is a top view showing the orientation of a detector in a top and an external activation device positioned proximate the top.

As an example of the operation of the detector 40 and the control circuit 42, consider the example embodied by FIG. 3. In FIG. 3, the external triggering device is a magnet 44 and the detector in the toy top is an induction coil 46. The magnet 44 can be held stationary outside the spinning top 12. As the toy top 12 spins, the induction coil 46 spins and therefore periodically passes through the magnet field created by the external magnet 44. When the induction coil 46 is far away from the magnet 44, the induction coil 46 is outside the magnetic field created by the magnet 44 and the current created in the induction coil 46 is zero. As the toy top 12 spins, the induction coil 46 approaches the external magnet 44 and thus enters the magnetic field created by the magnet 44. As the induction coil 46 passes into the magnetic field of the external magnet 44, a current is induced in the induction coil 46. The current created in the induction coil 46 increases as the induction coil approaches the external magnet 44 and the magnetic field created by the magnet 44 increases.

The induction coil 46 is wound around a central line that is aligned on the toy top 12 with a radius line that passes through the center axis of rotation. Due to the orientation of the induction coil 46, when the induction coil 46 passes directly in front of the external magnet 44, the induction coil 46 aligns with the magnetic field of the magnet 44 and no current is generated in the induction coil 46. As the induction coil 46 passes the external magnet 44, a current is again generated in the induction coil 46. However, the direction of the flow of current is opposite the direction of the original flow of current that was produced when the induction coil 46 was approaching the external magnet 44.

Figure 4:
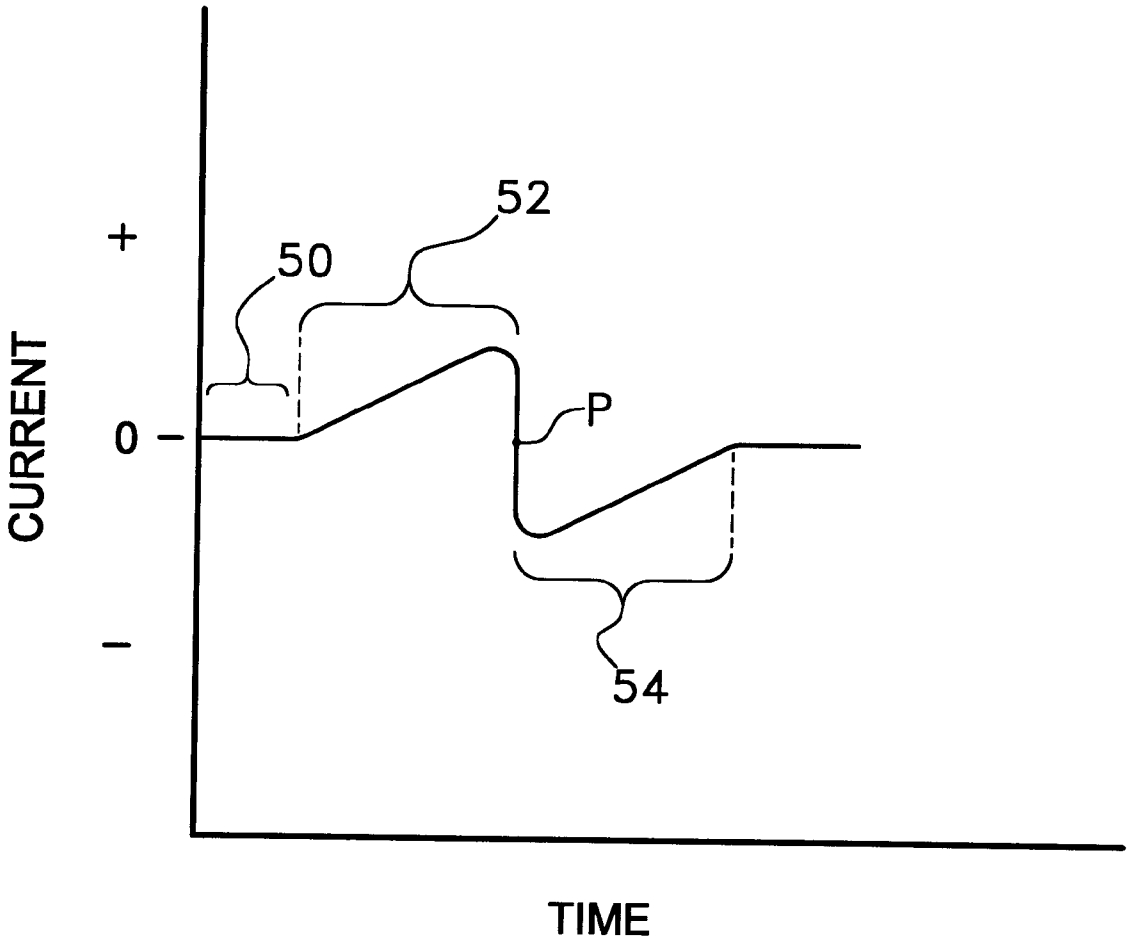
FIG. 4 is a graph showing current induced in an induction coil as the coil spins past a magnetic field.

Referring to FIG. 3 in conjunction with FIG. 4, it can be seen that when the induction coil 46 is distant from the external magnet 44, it does not pass through the magnetic field of the external magnet 44 and no current is generated in the induction coil 46. This is shown by the first segment 50 in FIG. 4. As the induction coil 46 approaches the external magnet 44, current is generated by the induction coil 46. The current increases as the induction coil 46 approaches the external magnet 44. This is shown by the second section 52 in FIG. 4. As the induction coil 46 passes the external magnet 44, the current rapidly drops to zero, as is indicated by point P in FIG. 4. As the induction coil 46 moves away from the external magnet 44, current is again produced. However, the current flows in the opposite direction. This is indicated by the third section 54 in FIG. 4.

When the induction coil 46 passes the external magnet 44 and the current changes direction of flow, this transition point can be recognized by a control circuit 42 (FIG. 3) and used as a triggering signal. Referring now back to FIG. 3, it can be seen that when the control circuit 42 initiates the LED driver circuit 34 and the array of LEDs 30 light. Furthermore, the control circuit 42 uses the triggering signals to synchronize the lighting of the array of LEDs 30 with the speed of rotation for the toy top 12. Each time the induction coil 46 (FIG. 4) triggers the control circuit 42, it can be assumed that the toy top 12 has competed a single revolution. Accordingly, the rate at which the control circuit 42 is triggered is indicative of the rate of rotation for the toy top 12. This enables the control circuit 42 to alter the rate at which the LED driver circuit 34 lights the LEDs in the array. Accordingly, the message set forth by the array of LEDs 30 is readable throughout the period of rotation for the toy top 12.

In the above example, the change in current flow is used to synchronize and trigger the lighting of the array of LEDs 30. If a photodetector were used instead of an induction coil, the transition point between increasing and decreasing light intensity would be used to synchronize and trigger the array of LEDs. If a radio signal detector where used in place of the induction coil, the transition point between increasing and decreasing signal intensity would be used to synchronize and trigger the array of LEDs.

Returning to FIG. 3, it can be seen that in this embodiment of the external triggering device, the position of the array of LEDs 30 and the magnet 44 are apart. It is the passage of the detector past the external triggering device that determines when the LEDs light. In the shown example, the array of LEDs 30 will light at the 12 o'clock position because this position corresponds to the point where the detector passes the external triggering device. However, as the external magnet 44 is moved, the point at which the array of LEDs 30 will begin to light also changes. Accordingly, on a spinning toy top 12, by moving the external triggering device around the periphery of the spinning top 12, the position at which the array of LEDs 30 create a display can be selectively altered.

Returning to FIG. 1, it will be understood that the external activation device 32 can be embodied in a secondary device such as a ring or a wand. To play with the toy top system 10, a person attaches the toy top 12 to the launcher mechanism 24, winds the launcher mechanism 24 and launches the toy top 12. The toy top 12 spins without any illuminated display. The person playing with the toy top 12 then brings an external triggering device 32 into close proximity with the spinning top 12. Once in close proximity, the array of LEDs 30 on the toy top 12 begin to light and create a readable display. The position of the display created on the spinning top 12 is dependent upon the position of the external triggering device 32 proximate the spinning top 12.

One embodiment of the present invention toy top system 10 can be that of a fortune top that is used to tell a person's fortune. The toy top 12 is preprogrammed with various fortune answers that can be randomly displayed. The person playing the fortune teller spins the top and asks a question. The person playing the fortune teller then brings the wand or the ring close to the spinning top. Once close enough to the top, the wand or ring activates the display of the top. The display randomly shows an answer, thus providing a fortune. The top may also display a prompt, such as a question mark, prior to displaying a fortune. The display of the prompt last a predetermined time, such as five seconds. After that period of time, the fortune answer is displayed. As such, a person using the top can use the prompt to time the asking of questions. In this manner a fortune can be displayed on que in a timely manner after a question is asked.

It will be understood that the various figures described above illustrate only exemplary embodiments of the present invention. A person skilled in the art can therefore make numerous alterations and modifications to the shown embodiments utilizing functionally equivalent components to those shown and described. All such modifications are intended to be included within the scope of the present invention as defined by the appended claims.

What is claimed is:

1. A system, comprising:

a top;

an array of lights supported by said top, wherein said array of lights are visible to a person observing said top;

a handheld activation device separate from said top that can be selectively held within a predetermined distance of said top, wherein said handheld activation device includes a magnetic source;

an induction coil supported at a predetermined position in said top, said induction coil producing a trigger signal each time said induction coil rotates within said predetermined distance of said handheld activation device, thereby producing a trigger signal rate that corresponds to a rate of rotation for said top when said handheld activation device is brought within said predetermined distance of said top; and a control circuit supported by said top and coupled to both said induction coil and said array of lights, wherein said control circuit lights said array of lights in at least one preprogrammed sequence that is variably synchronized to match said trigger signal rate.

2. The system according to claim 1, wherein said preprogrammed sequence of lighting said array of lights is randomly selected from a plurality of different preprogrammed sequences.

3. The system according to claim 1, wherein said at least one preprogrammed sequence causes said array of lights to display a sequence of alpha-numeric characters.

4. The system according to claim 1, further including a launch mechanism for engaging and spinning said top at a predetermined initial rate of rotation.

5. The system according to claim 1, wherein said induction coil is wound around a central axis and said central axis is radially oriented on said top.

6. A toy top device, comprising:

a rotatable body;

an array of lights visible on said rotatable body;

an induction coil supported at a predetermined position in said rotatable body, said induction coil producing a trigger signal each time said induction coil rotates through a magnetic field of a predetermined strength, thereby producing a trigger signal rate; and circuitry supported by said rotatable body and coupled to both said induction coil and said array of lights, wherein said circuitry lights said array of lights in at least one preprogrammed sequence that is variably synchronized to match said trigger signal rate.

7. The device according to claim 6, wherein said induction coil is wound around a central axis and said central axis is radially oriented on said rotatable body.

* * * * *